US009093787B2

(12) United States Patent
Marten et al.

(10) Patent No.: US 9,093,787 B2
(45) Date of Patent: Jul. 28, 2015

(54) LATCHING CONNECTOR ASSEMBLY

(71) Applicant: Amphenol Corporation, Wallingford, CT (US)

(72) Inventors: Barbara Heather Marten, Toronto (CA); Valeria Caraiani, Thornhill (CA); Peter Ervin Jay, Toronto (CA); Stewart Clark, Cobourg (CA)

(73) Assignee: Amphenol Corporation, Wallingford, CT (US)

( * ) Notice: Subject to any disclaimer, the term of this patent is extended or adjusted under 35 U.S.C. 154(b) by 28 days.

(21) Appl. No.: 13/834,616

(22) Filed: Mar. 15, 2013

(65) Prior Publication Data

US 2014/0273589 A1 Sep. 18, 2014

(51) Int. Cl.

| | |
|---|---|
| ***H01R 4/50*** | (2006.01) |
| ***H01R 13/625*** | (2006.01) |
| ***H01R 13/629*** | (2006.01) |
| ***H01R 13/627*** | (2006.01) |
| *H01R 13/58* | (2006.01) |
| *H01R 13/645* | (2006.01) |

(52) U.S. Cl.

CPC ..... *H01R 13/62911* (2013.01); *H01R 13/6275* (2013.01); *H01R 13/6278* (2013.01); *H01R 13/5825* (2013.01); *H01R 13/645* (2013.01)

(58) Field of Classification Search

CPC ..... H01R 13/6275; H01R 13/6278
USPC ..... 439/347, 332, 616, 352, 460, 353, 357, 439/358

See application file for complete search history.

(56) References Cited

U.S. PATENT DOCUMENTS

| | | | | |
|---|---|---|---|---|
| 5,387,123 | A * | 2/1995 | Puerner | 439/460 |
| 5,411,413 | A | 5/1995 | Yamamoto | |
| 5,425,653 | A * | 6/1995 | Koiso | 439/347 |
| 5,478,255 | A | 12/1995 | Hashiguchi | |
| 5,588,862 | A * | 12/1996 | Perkins et al. | 439/347 |
| 5,611,703 | A | 3/1997 | Okamoto et al. | |
| 6,155,851 | A | 12/2000 | Kazuhara | |
| 6,190,187 | B1 | 2/2001 | Okabe et al. | |
| 6,361,362 | B1 | 3/2002 | Kressmann et al. | |
| 6,485,315 | B1 * | 11/2002 | Hwang | 439/108 |
| 6,663,403 | B2 | 12/2003 | Hsu | |

(Continued)

FOREIGN PATENT DOCUMENTS

| | | |
|---|---|---|
| FR | 2563950 | 11/1985 |
| JP | 07-029636 | 1/1995 |
| JP | 2004-259552 A | 9/2004 |

*Primary Examiner* — Felix O Figueroa

(74) *Attorney, Agent, or Firm* — Blank Rome LLP

(57) ABSTRACT

An electrical connector assembly that has first and second connectors. The first connector includes a main body, a locking member, and first engagement members. The locking member includes an indented portion. The second connector receives the first connector. The second connector includes a main body and a latching member. The latching member includes a biasing member and second engagement members configured to receive the first engagement members. The locking member is configured to deflect the biasing member when the first connector is inserted into the second connector such that the biasing member engages the indented portion thereby retaining the locking member in a locked position and indicating proper mating of the connectors. The latching member slides with respect to the main body of the second connector to a latched position until the second engagement members receive the first engagement members for securely mating the connectors.

17 Claims, 3 Drawing Sheets

(56) References Cited

U.S. PATENT DOCUMENTS

| | | | | |
|---|---|---|---|---|
| 6,700,083 | B2 | 3/2004 | Konda | |
| 6,890,194 | B2 | 5/2005 | Katsuma | |
| 7,008,257 | B2 | 3/2006 | Zhu et al. | |
| 7,118,395 | B2 | 10/2006 | Tsuji | |
| 7,329,138 | B2 | 2/2008 | Van Der Mee et al. | |
| 7,524,214 | B2 | 4/2009 | Johnson et al. | |
| 7,695,296 | B1 | 4/2010 | Hitchcock et al. | |
| 8,206,170 | B2 * | 6/2012 | Matsumoto et al. | 439/347 |
| 2004/0043655 | A1 | 3/2004 | Godefroy et al. | |
| 2010/0035450 | A1 | 2/2010 | Chang et al. | |

* cited by examiner

FIG. 2
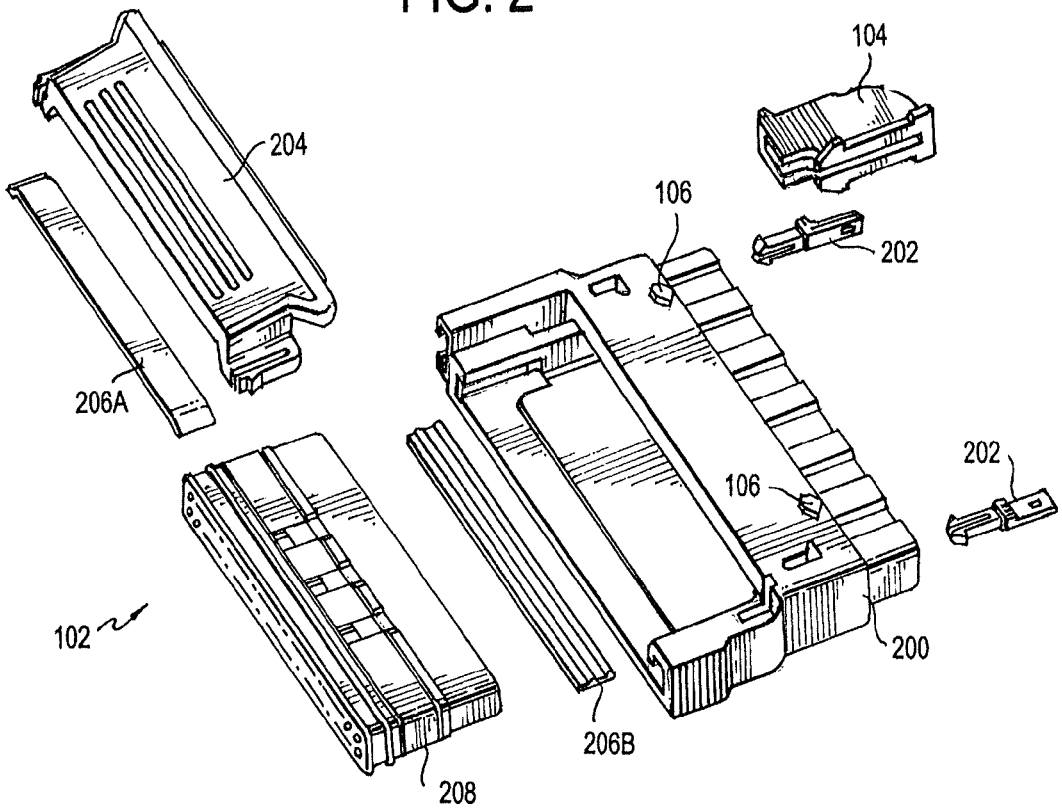
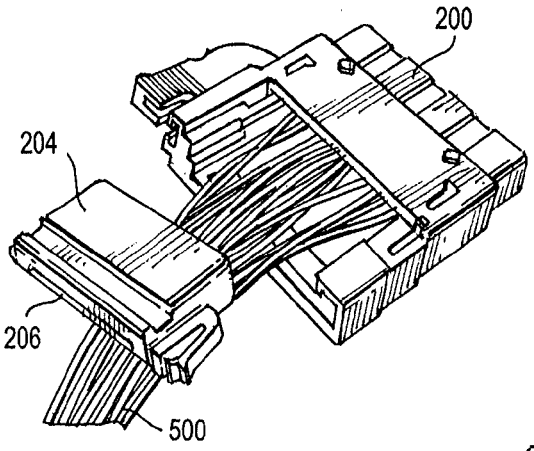
FIG. 5A
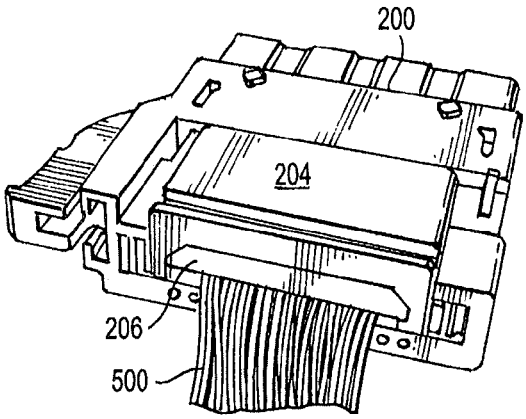
FIG. 5B

LATCHING CONNECTOR ASSEMBLY

FIELD OF THE INVENTION

The present invention relates to an electrical connector assembly. In particular, the present invention relates to an electrical connector assembly with a sliding latching mechanism for easily mechanically and electrically connecting a first and second connector of the connector assembly with one hand.

BACKGROUND OF THE INVENTION

Conventional connector assemblies, such as a connector assembly including a plug and a receptacle, include a variety of configurations for a variety of different applications. In applications where a human operator needs to mate and unmate a plug and a receptacle, it may be desirable to allow the operator to perform these functions with one hand and without requiring a large amount of physical force. In addition to allowing an operator to mate or unmate a connector with ease, it may also be desirable to provide a visual or non-visual indication to the operator of a successful (or unsuccessful) mating.

Conventional connector assemblies often require the use of two hands in order to mate or unmate the plug and receptacle. For example, some conventional locking mechanisms are designed such that, when the plug and receptacle are mated, an operator must hold the receptacle firmly with one hand and interact with a locking mechanism while pulling on the plug in order to unmate the connectors.

Additionally, many conventional connector assemblies do not provide any indication of proper mating. For example, some conventional connectors do not change their appearance or the amount of physical force required to mate or unmate depending on whether the connectors are properly or improperly mated. This leaves operators to determine, via other means, whether a connection has been made and makes it more difficult to locate improperly mated connections.

Accordingly, there is a need for a connector that does not use fasteners or require a large amount of physical force in order to mate a plug and a receptacle, and that provides a visual and/or non-visual indication to the operator of a successful (or unsuccessful) mating.

SUMMARY OF THE INVENTION

Those and other objects and features of the present invention are accomplished by an electrical connector assembly comprising a first connector and a second connector. The first connector includes a main body, a locking member, and first engagement members. The locking member includes an indented portion. The second connector is configured to receive the first connector. The second connector includes a main body and a latching member that is slidable with respect to the main body. The latching member includes a biasing member and second engagement members configured to receive the first engagement members. The locking member of the first connector is configured to deflect the biasing member of the second connector when the first connector is inserted into the second connector such that the biasing member engages the indented portion of the locking member thereby retaining the locking member in a locked position and indicating proper mating of the first connector and the second connector. The latching member slides with respect to the main body of the second connector to a latched position until the second engagement members receive the first engagement members for securely mating the first and second connectors.

According to another embodiment, a spring-loaded latching electrical connector assembly is disclosed. The spring-loaded latching electrical connector assembly includes a plug and a receptacle. The plug includes a main body, a locking wedge, and first engagement members. The locking wedge includes an indented portion. The receptacle is configured to receive the plug. The receptacle includes a main body and a latching member that is slidable with respect to the main body. The latching member includes a biasing member and second engagement members configured to receive the first engagement members. The locking wedge of the plug is configured to deflect the cantilevered spring of the receptacle when the plug is inserted into the receptacle such that the cantilevered spring engages the indented portion of the locking wedge thereby retaining the locking wedge in a locked position and indicating proper mating of the plug and the receptacle. The latching member slides with respect to the main body of the receptacle to a latched position until the bayonet tracks receive the bayonets for securely mating the plug and the receptacle.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

FIG. 2 is an exploded perspective view of a first connector in accordance with an exemplary embodiment of the invention;

FIG. 5A is a perspective view of a cable and a strain relief sub-assembly in accordance with an exemplary embodiment of the invention showing a strain relief feature before the sub-assembly is inserted into the first connector; and FIG. 5B is a perspective view of a cable and a strain relief sub-assembly illustrated in FIG. 5A showing the strain relief feature after the sub-assembly is inserted into the first connector.

DETAILED DESCRIPTION OF THE PREFERRED EMBODIMENTS

Figure 1:
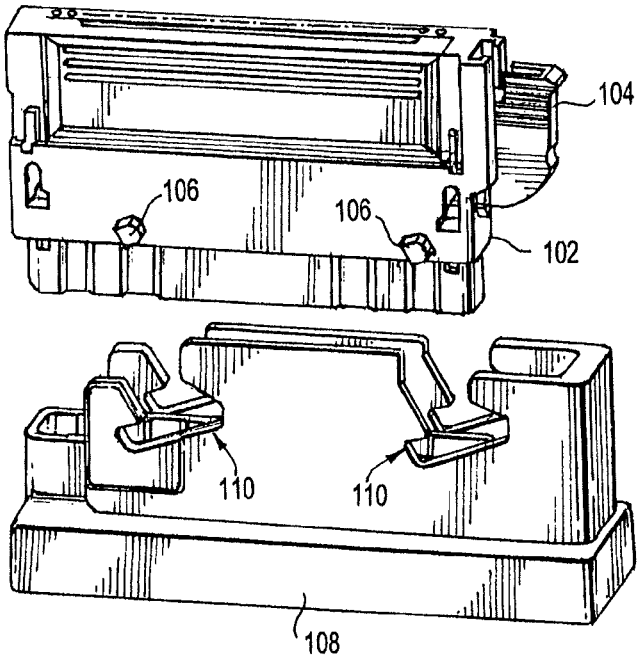
FIG. 1 is an exploded perspective view of a connector assembly in accordance with an exemplary embodiment of the invention.

Several preferred embodiments of the invention are described for illustrative purposes, it being understood that the invention may be embodied in other forms not specifically shown in the drawings. Referring to FIGS. 1-3, 4A, and 4B, the present invention provides a connector assembly 100 that cannot be unmated by accident; that provides a visual and/or physical indication of proper mating of the assembly; that can be operated by hand without the use of tools; and that allows an operator to fully unmate the connectors using a relatively small amount of force (e.g., 15-20 lbs.) by pushing on a portion of the connector assembly rather than requiring the operator to pull the connectors apart.

As used herein, the terms "mate," "mating," and "mate sequence" refer to the process of mechanically and electrically connecting a first connector (e.g., a plug) and a second connector (e.g., a receptacle), while the terms "unmate" and "un-mate" refer to the opposite process of mechanically and electrically disconnecting a plug and a receptacle.

FIG. 1 is a perspective view of the connector assembly 100 in accordance with an exemplary embodiment of the invention. Referring to FIG. 1, the connector assembly 100 includes a first connector 102, which may be a plug, and a second connector 108, which may be a receptacle, where the plug 102 is insertable into the receptacle 108 to ensure a reliable physical and electrical connection between electrical components (e.g., PC board and cable).

As will be described in greater detail below, the plug 102 includes a locking member 104, which may be a wedge, for preventing accidental unmating when in the locked position. In order to indicate proper mating of the plug 102 and the receptacle 108, the locking wedge 104 includes a notched portion 400 (FIG. 4A) in which a biasing member 310 of the receptacle 108 rests for retaining the locking wedge 104 in a locked position. The plug 102 may also include one or more first engagement members 106, that are preferably bayonets, for engaging with corresponding second engagement members 110, which may be bayonet tracks, located on the receptacle 108 for securing the connectors in a locked position.

The receptacle 108 is configured to receive the plug 102 therein. As mentioned above, the receptacle 108 may also include one or more bayonet tracks 110 for receiving one or more bayonets 106 of the plug during a mate sequence. Specific features of the plug 102 and the receptacle 108 will be described in greater detail below. Although it is preferable that the connectors mate by bayonet and corresponding bayonet track engagement, any suitable engagement members may be used without departing from the scope of the subject matter described herein.

FIG. 2 is an exploded view of the plug 102 in accordance with an embodiment of the invention. Referring to FIG. 2, the plug 102 may include a plug main body 200, one or more polarization keys 202, a strain relief outer portion 204, elastomer pads 206, and a strain relief insert sub-assembly 208. The locking wedge 104 is preferably located at an end of the main body 200, as seen in FIG. 1. The polarization keys 202 maintain proper axial polarization alignment between the connectors. The polarization keys 202 intermate with corresponding polarization keys 306 so that only the correct plug 102 with matching key orientation will mate with the receptacle 108. The elastomer pads 206 may be inserted between the main body 200 and the sub-assembly 208 for cushioning the cable wires secured by the strain relief insert sub-assembly 208 and preventing chafing. The strain relief insert sub-assembly 208 is insertable into an opening 210 at the rear of the plug main body 200. The sub-assembly 208 may be both removable and configured to snap into place with respect to the main body 200.

Figure 3:
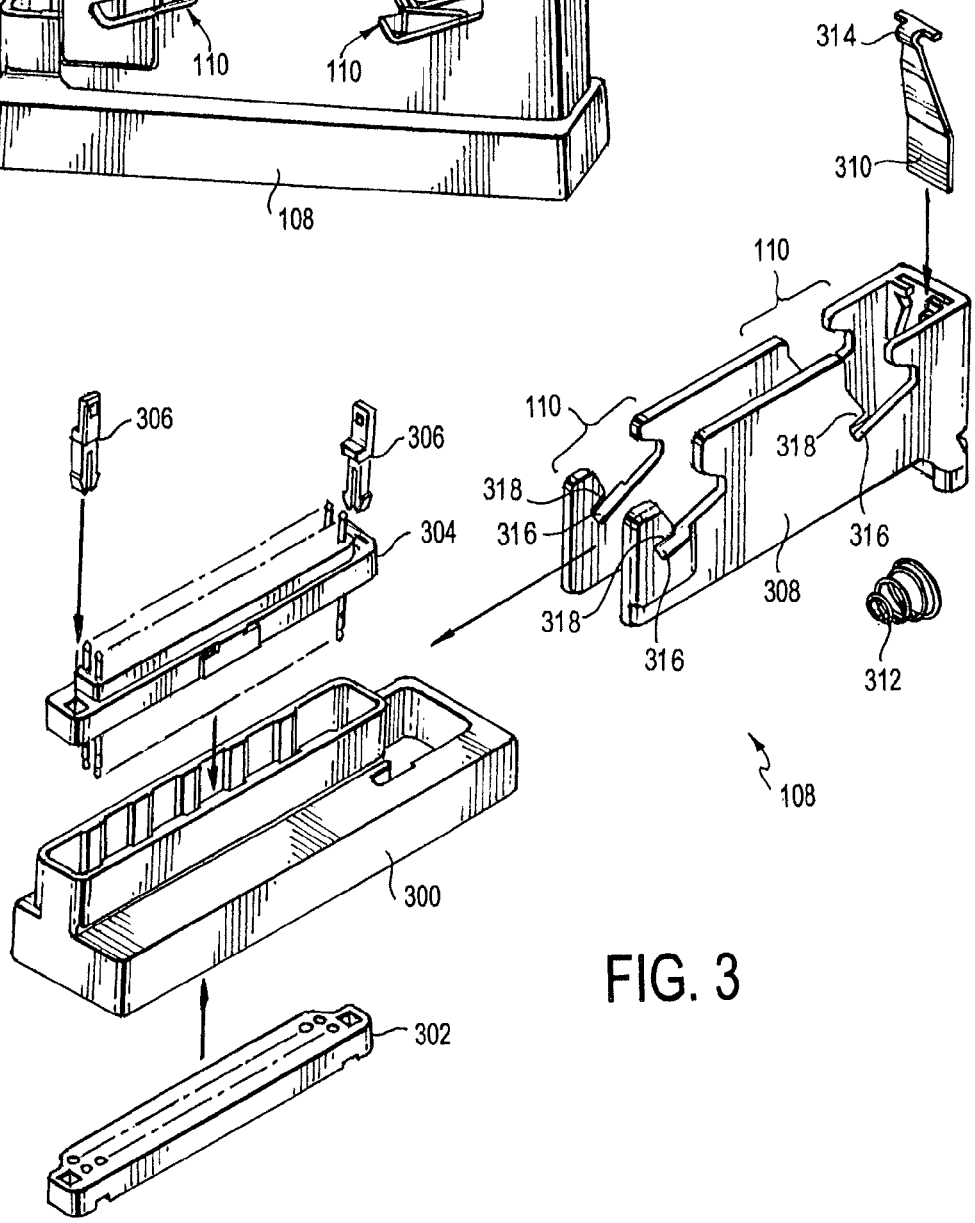
FIG. 3 is an exploded perspective view of a second connector in accordance with an exemplary embodiment of the invention.

FIG. 3 is an exploded view of the receptacle 108 in accordance with an embodiment of the invention. Referring to FIG. 3, the receptacle 108 may include a receptacle main body 300 for securing together parts of the receptacle 108. An alignment insert 302 may be coupled to the receptacle main body 300 for aligning contacts. The sliding member 308 is slidably coupled to the receptacle main body 300 between latched and unlatched positions. An engaging insert 304 may also be coupled to the receptacle main body 300 opposite the alignment insert 302 for engaging the sliding latching mechanism 308 and securing the contacts. The polarization keys 306 may be provided at opposite ends of the engaging insert 304 and the receptacle main body 300 for securing the engagement insert 304. The polarization keys 306 intermate with corresponding polarization keys 202, so that only the correct plug 102 with matching key orientation will mate with the receptacle 108. The sliding member 308 includes a first biasing member 310 that may be used for securing the locking wedge 104 of the plug in the locked position upon successful mating of the plug and the receptacle. Additional details of the sliding member 308 will now be described in greater detail below with respect to exemplary mating and unmating processes.

The first biasing member 310 is preferably a cantilever spring. The spring is preferably disposed inside of the latching member 308, at an end thereof, as seen in FIG. 3. The first biasing member 310 may include a shaped end 314 that corresponds to the notch 400 located on the locking wedge 104 of the plug such that, when the plug and the receptacle are fully engaged upon successful mating, the shaped end 314 of the first biasing member 310 rests in the notch 400 located on the locking wedge 104.

The sliding member 308 further includes a biasing member 312 that may be used for providing resistive force between the receptacle main body 300 and the sliding member 308. The second biasing member 312 is preferably a conical spring. When the sliding member 308 is slid away from the receptacle main body 300 in order to align the first engagement members 106 with the second engagement members 110, the resistive force of the second biasing member 312 may increase. As such, the human operator must counteract this force by pulling on the sliding member 308 in order to unmate the connectors. This may allow for the sliding member 308 to slide to a latched position to allow bayonets 106 of the plug to engage with the bayonet tracks 110 of the receptacle during mating of the connectors. When the operator releases the sliding member 308, the resistive force of the second biasing member 312 may return the sliding member 308 to the latched position.

Figure 4A:
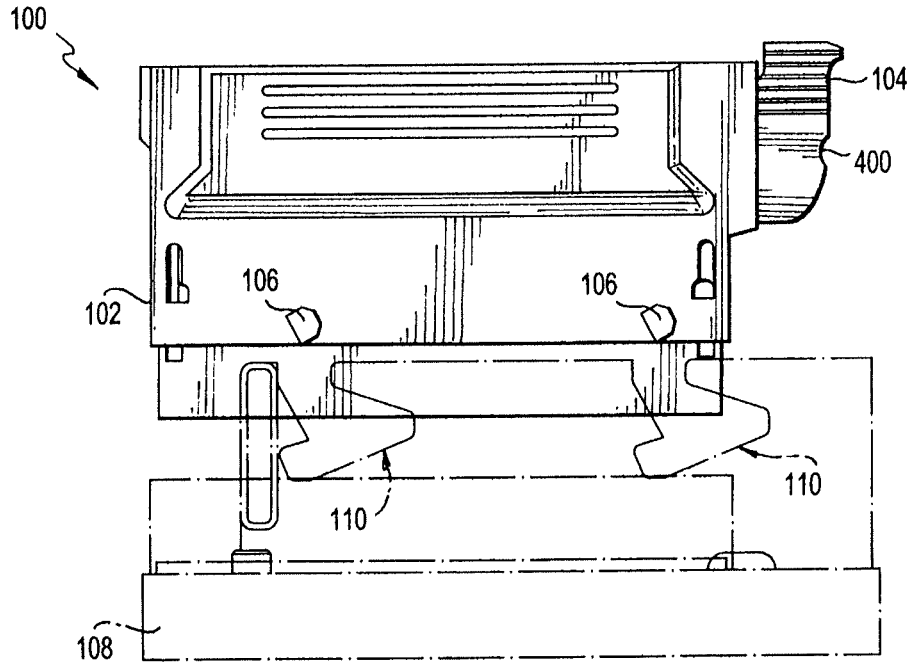
FIG. 4A is a side elevational view of the connector assembly illustrated in FIG. 1 showing the connector assembly before mating in accordance with an exemplary embodiment of the invention.
Figure 4B:
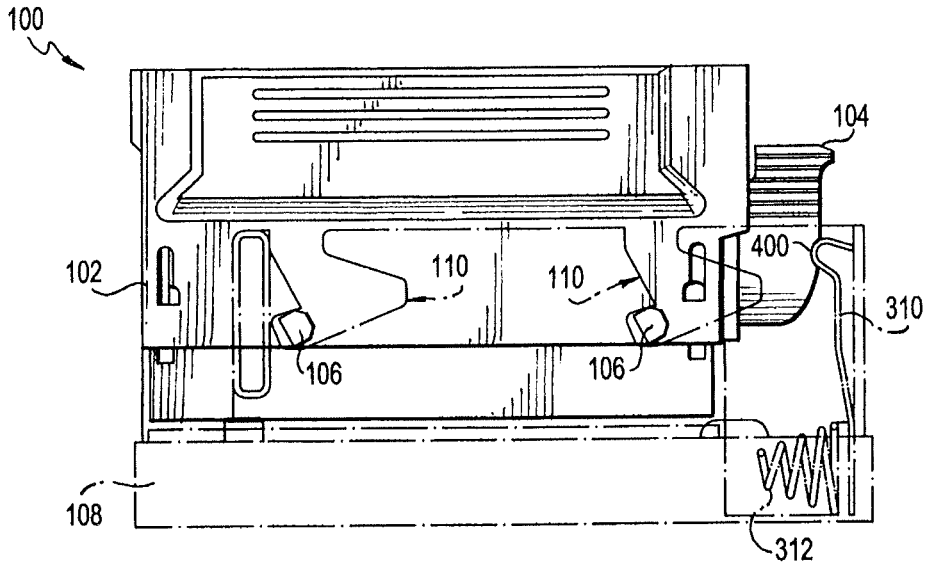
FIG. 4B is a side elevational view of a connector assembly illustrated in FIG. 1 showing the connector assembly after mating in accordance with an exemplary embodiment of the invention.

During mating of the plug 102 with the receptacle 108, the locking wedge 104 of the plug deflects the first biasing member 310 of the receptacle 108 to increase the clamping force between the mated plug 102 and the receptacle 108. For example, as the first biasing member 310 is deflected, the first biasing member 310 produces a resistive force that opposes the force associated with the deflection. Because the locking wedge 104 is narrower at one end and wider at the other end (i.e., a wedge), as best seen in FIGS. 4A and 4B, this resistive force increases as the locking wedge 104 further deflects the first biasing member 310 as locking wedge 104 is pushed into the locked position where the shaped end 314 engages notch 400. However, once the first biasing member 310 reaches the notch 400 located on the locking wedge 104, the resistive force slightly decreases because the amount of deflection is lessened. When the shaped end 314 of the first biasing member 310 rests in the notch 400 located on the locking wedge 104, this is the locked position and, because the resistive force increases in order to move the shaped end 314 of the first biasing member 310 out of the notch 400, the force applied by the first biasing member 310 may be referred to as a clamping force.

In the locked position, the locking wedge 104 provides a visual indication to the operator that the connector assembly 100 is in the locked position. Also in the locked position, the tracks 110 of the sliding member 308 are engaged with the plug bayonets 106. For example, the bayonet tracks 110 may include a portion 316 into which the bayonets 106 rest when in the locked position. This portion 316 of the bayonet tracks 110 may include an overhanging portion 318 of the sliding member 308 which prevents the first connector 102 from being unmated (e.g., pulled apart) from the second connector 108 by blocking the bayonets 106. Any gap between the first connector 102 and the second connector 108 may be controlled within predetermined tolerances in order to ensure electrical engagement.

FIGS. 4A and 4B are side views of an exemplary mate sequence in accordance with an embodiment of the invention showing the connector assembly 100 before/after mating of the plug 102 with the receptacle 108. Referring to FIGS. 4A and 4B, successful mating of the plug 102 and the receptacle 108 begins when the bayonets 106 slide into the top openings of the bayonet tracks 110 and the front end of the plug 102 engages with the opening of the receptacle body 300. Further engagement of the plug 100 causes the bayonets 106 to slide against the angled surface of the bayonet tracks 110 and push the sliding member 308 against the bias force from bias member 312. The bayonets 106 are pushed passed the retaining feature 318 of the bayonet track 110 and the bias force of the bias member 312 causes the sliding member 308 to snap back into a locking position. The locking wedge 104 is pushed downward into the locked position, the locking wedge 104 deflects the biasing member 310 which increases the clamping force between the plug 102 and the receptacle 108 once mated. If the tracks 110 of the sliding member 308 do not fully engage with the plug bayonets 106, then the locking wedge 104 will not drop into its locked position and/or the install force required may be unusually high. Thus, the operator will be alerted to an improper mating of the connector assembly 100 by the position of the locking wedge 104, the sliding member 108, the biasing member 310, the first engagement members 106, and/or the second engagement members 110.

In order to release the plug 102 from the receptacle 108, the locking wedge 104 must be pulled out from its locked position. The sliding member 308 may be slid (e.g., to the right in FIG. 4B) from its latched position and an unlatched position against the bias of spring 312. Once the sliding member 308 has been released, the bayonets 106 may be in line with the opening of the bayonet tracks 110 such that the plug 102 may be lifted and separated from the receptacle 108. If the sliding member 308 is not properly displaced to the unlatched position, the plug bayonets 106 will prevent the plug 102 from being separated from the receptacle 108 because the bayonets 106 will be blocked by the bayonet tracks 110.

FIG. 5A is a perspective view of a cable and a strain relief sub-assembly in accordance with an embodiment of the invention showing a strain relief feature before the sub-assembly is inserted into a plug assembly. FIG. 5B is a perspective view of the cable and a strain relief sub-assembly in accordance with an embodiment of the invention showing a strain relief feature after the sub-assembly is inserted into a plug assembly. Conventional strain relief features of connector assemblies typically include a projection, or a round port, which acts as an anchor for a wire tie strap (e.g., zip tie). For example, some conventional strain relief features use bars with a rubber strip to secure the wire using separate parts, which are screwed into place. In contrast to typical strain relief features, which require extra steps and/or parts, the strain relief feature 204-208 disclosed herein employs rubber strips 206A and 206B which secure the cable wires 500 without any extra steps and/or parts. Instead, the relief strain insert 206 may be hinged and configured to snap in/out (i.e., inserted) of the plug main body 200 without the use of tools. Referring to FIG. 5A, the relief strain insert 206 is shown in an un-inserted position. This may allow greater flexibility than conventional strain relief features. Referring to FIG. 5B, the relief strain insert 206 is shown fully inserted into the plug main body 200 for securely holding the wires 500 without the use of extra screws or tools.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A spring-loaded latching electrical connector assembly, comprising:

a plug, said plug including a main body, a locking wedge, and first engagement members, said locking wedge including an indented portion; and a receptacle configured to receive said plug, said receptacle including a main body and a latching member that is slidable with respect to said main body of said receptacle, said latching member including a cantilevered spring and second engagement members configured to receive said first engagement members, wherein said locking wedge of said plug is configured to deflect said cantilevered spring of said receptacle when said plug is inserted into said receptacle such that said cantilevered spring engages said indented portion of said locking wedge thereby retaining said locking wedge in a locked position and indicating proper mating of said plug and said receptacle and said latching member slides with respect to said main body of said receptacle to a latched position until said first and second engagement members engage one another for securely mating said plug and said receptacle, wherein said first and second engagement members are one of bayonet tracks and bayonets.

2. An electrical connector assembly, comprising:

a first connector, said first connector including a main body, a locking member, and first engagement members, said locking member including an indented portion; and a second connector configured to receive said first connector, said second connector including a main body and a latching member that is slidable with respect to said main body of said second connector, said latching member including a biasing member and second engagement members configured to receive said first engagement members, wherein said locking member of said first connector is configured to deflect said biasing member of said second connector when said first connector is inserted into said second connector such that said biasing member engages said indented portion of said locking member thereby retaining said locking member in a locked position and indicating proper mating of said first connector and said second connector, and said latching member slides with respect to said main body of said second connector to a latched position until said second engagement members receive said first engagement members for securely mating said first and second connectors.

3. The electrical connector assembly of claim 2 wherein said first connector is a plug.

4. The electrical connector assembly of claim 2 wherein said second connector is a receptacle.

5. The electrical connector assembly of claim 2 wherein said first engagement members are bayonets.

6. The electrical connector assembly of claim 5 wherein said second engagement members are bayonet tracks.

7. The electrical connector assembly of claim 2 wherein said biasing member is a cantilevered spring member.

8. The electrical connector assembly of claim 2 wherein said first connector and said second connector are unmated by sliding said latching member to an unlatched position such that said first engagement members disengage from said second engagement members.

9. The electrical connector assembly of claim 2 further comprising a strain relief assembly insertable into said first connector, said strain relief assembly including a clamp for securing wires to said first connector.

10. The electrical connector assembly of claim 2 further comprising a second biasing member for providing resistive force between said receptacle main body and said latching member biasing said latching member to said latched position.

11. The electrical connector assembly of claim 10 wherein said second biasing member is a conical spring.

12. The electrical connector assembly of claim 2 wherein said biasing member includes a shaped end that engages said indented portion of said locking member, thereby retaining said locking member in said locked position.

13. The electrical connector assembly of claim 2 wherein said locking member is located on an outer end of said main body of said first connector.

14. The electrical connector assembly of claim 2 wherein said biasing member is located on an inside portion of an end of said second connector.

15. The electrical connector assembly of claim 2 further comprising an alignment insert coupled to said main body of said second connector for aligning contacts within said main body of said second connector.

16. The electrical connector assembly of claim 15 further comprising an engaging insert coupled to said main body of said second connector and being located opposite said alignment insert.

17. The electrical connector assembly of claim 16 further comprising polarization keys located at opposite ends of said engaging insert.

* * * * *